United States Patent [19]

Nakajima

[11] Patent Number: 4,813,854

[45] Date of Patent: Mar. 21, 1989

[54] VARIABLE CAPACITY VANE COMPRESSOR

[75] Inventor: Nobuyuki Nakajima, Saitama, Japan

[73] Assignee: Diesel Kiki Co., Ltd., Tokyo, Japan

[21] Appl. No.: 196,329

[22] Filed: May 20, 1988

[30] Foreign Application Priority Data

Jul. 31, 1987 [JP] Japan ..... 62-193274

[51] Int. Cl.[4] ..... F04B 49/00; F04C 29/08

[52] U.S. Cl. ..... 417/295; 417/310

[58] Field of Search ..... 417/295, 310

[56] References Cited

U.S. PATENT DOCUMENTS 4,726,740 2/1988 Suzuki et al. ..... 417/295

FOREIGN PATENT DOCUMENTS 62-20688 1/1987 Japan .
62-129593 6/1987 Japan .
62-132289 8/1987 Japan .

*Primary Examiner*—William L. Freeh
*Attorney, Agent, or Firm*—Frishauf, Holtz, Goodman & Woodward

[57] ABSTRACT

A variable capacity vane compressor has a cylinder within which a pair of compression spaces are defined between the cylinder and a rotor rotatably received within the cylinder at diametrically opposite locations, and a control element disposed in the cylinder for rotation about its own axis in circumferentially opposite directions in response to a difference between pressure from a lower pressure zone and pressure from a higher pressure zone. The control element has its outer peripheral edge formed with a pair of cut-out portions at substantially diametrically opposite locations, which each have a leading end in the direction of rotation of the rotor. The rotation of the control element causes a change in the circumferential position of each cut-out portion to thereby vary the timing of commencement of compression in the corresponding compression space and hence vary the compressor capacity. The leading ends of the cut-out portions are located at diametrically asymmetric locations to provide a difference in the timing of commencement of compression between the compression spaces. Therefore, the compressor as a whole is free from insufficient compression and can provide sufficient discharge pressure even when it assumes the minimum capacity position.

2 Claims, 14 Drawing Sheets

VARIABLE CAPACITY VANE COMPRESSOR

BACKGROUND OF THE INVENTION

This invention relates to vane compressors for use as refrigerant compressors in automotive air conditioning systems or like systems, and more particularly to variable capacity vane compressors of the type that the compressor capacity is controlled by varying the timing of commencement of compression.

Variable capacity vane compressors of this type have been proposed e.g. by Japanese Provisional Patent Publication (Kokai) Nos. 62-20688 and 62-129593. These proposed vane compressors are constructed as shown in FIG. 1 through FIG. 4. As shown in FIGS. 1 and 2, a rotor B is rotatably fitted within a cylinder formed by a cam ring A and two side blocks closing opposite ends of the cam ring A, and carries vanes $D_1$–$D_5$ radially slidably fitted in respective slits formed in the outer peripheral surface thereof. Two compression spaces $C_1$ and $C_2$ are defined within the cylinder by the inner peripheral surface of the cam ring A and the outer peripheral surface of the rotor B at diametrically opposite locations. During the suction stroke when compression chambers each defined between adjacent two vanes increase in volume, compression fluid is drawn from a suction chamber into the compression chambers through refrigerant inlet ports E and E, as shown in FIG. 3. During the compression stroke following the suction stroke, when the compression chambers decrease in volume, the drawn compression fluid is compressed to be discharged through refrigerant outlet ports F and F and discharge valves G and G into a discharge pressure chamber. An annular recess I is formed in an end face of one H of the side blocks formed with the refrigerant inlet ports E and E, which end face faces the rotor B. Two pressure working chambers J and J are defined in the annular recess I at diametrically opposite locations, which communicate with the suction chamber and the discharge pressure chamber. A control element L is rotatably fitted in the annular recess I, which has a side surface thereof formed with two pressure-receiving protuberances K and K slidably fitted in the respective pressure working chambers J and J to divide each of them into a first pressure chamber communicating with the suction chamber and a second pressure chamber communicating with the discharge pressure chamber, such that the control element is rotatable in opposite directions in dependence on the difference in pressure between the first and second pressure chambers, between a maximum capacity position and a minimum capacity position. The control element L has an outer peripheral edge thereof formed with two arcuate cut-out portions $L_1$ and $L_2$ at diametrically opposite locations, which determine the timing of commencement of compression stroke such that the fluid compression starts when a trailing one of two adjacent vanes passes a leading end of each cut-out portion $L_1$, $L_2$ in the direction of rotation of the rotor B. The timing of commencement of compression can thus be varied through the whole range as the control element L is rotated between the maximum capacity position as indicated by the solid lines in FIGS. 1 and 3 and the minimum capacity position as indicated by the two-dot chain lines in FIGS. 2 and 3 so that the compression amount or capacity varies between the maximum value as shaded in FIG. 1 to the minimum value as shaded in FIG. 2.

However, according to the above proposed vane compressors, if the location of the leading end of each cut-out portion $L_1$, $L_2$ is shifted so as to further retard the timing of commencement of compression when the compressors are in the minimum capacity position and hence further decrease the minimum compression amount in order to increase the variable range of the compressor capacity, this causes insufficient compression, because there is a fixed "dead volume", that is, a non-compressed volume, in each refrigerant outlet port F, F, and therefore if the minimum compression amount is decreased, the ratio of the dead volume to the minimum compression amount increases, causing insufficient compression. Furthermore, since the two cut-out portions of the control element L are located at diametrically opposite locations and accordingly the two compression spaces $C_1$ and $C_2$ have the same timing of commencemnt of compression, the above-mentioned insufficient compression will take place in both of the two compression spaces $C_1$ and $C_2$ if the minimum compression amount is decreased as above. As a result, the compressors cannot provide desired discharge pressure when they are in the minimum capacity position.

SUMMARY OF THE INVENTION

It is therefore the object of the invention to provide a variable capacity vane compressor in which the timing of commencement of compression is different between the two compression spaces to thereby obtain a large variable range of capacity as well as sufficient discharge pressure even in the minimum capacity position in which the minimum compression amount is obtained.

To attain the above object, the present invention provides a variable capacity vane compressor having a cylinder, a rotor rotatably received within the cylinder, a pair of compression spaces being defined between the cylinder and the rotor at diametrically opposite locations, a plurality of vanes carried by the rotor, a control element disposed in the cylinder for rotation about an axis thereof in circumferentially opposite directions, the control element having an outer peripheral edge thereof formed with a pair of cut-out portions at substantially diametrically opposite locations, the cut-out portions each having a leading end in the direction of rotation of the rotor, a lower pressure zone, a higher pressure zone, and means for rotating the control element in response to a difference between pressure from the lower pressure zone and pressure from the higher pressure zone, wherein compression of compression fluid commences when each of the vanes passes the leading end of each of the cut-out portions, whereby the rotation of the control element causes a change in the circumferential position of each of the cut-out portions to thereby vary the timing of commencement of compression in a corresponding one of the compression spaces and hence vary the capacity of the compressor.

The variable capacity vane compressor according to the invention is characterized by an improvement wherein the leading ends of the cut-out portions of the control element are located at diametrically asymmetric locations to provide a difference in the timing of commencement of compression between the compression spaces.

The above and other objects, features, and advantages of the invention will be more apparent from the ensuing detailed description taken in conjunction with the accompanying drawings.

DETAILED DESCRIPTION

Figure 1:
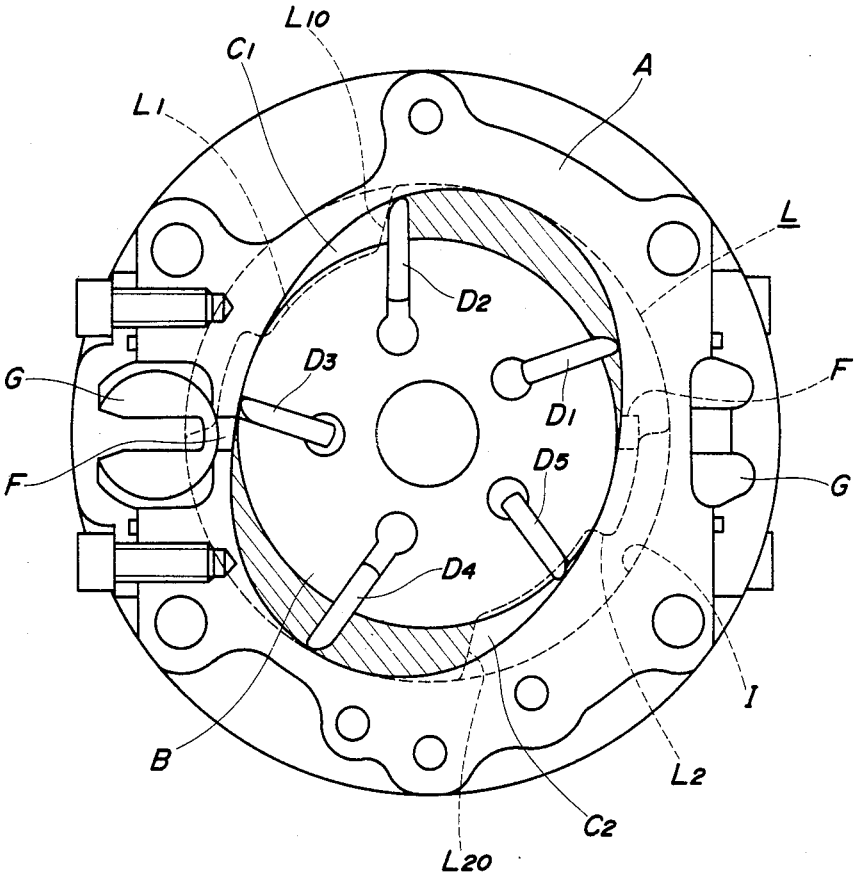
FIG. 1 PRIOR ART
FIG. 1 is a view useful in explaining the positional relationship between vanes and cut-out portions of a control element in a conventional vane compressor, assumed in the maximum capacity position, as well as the compression amount obtained in the maximum capacity position.
Figure 2:
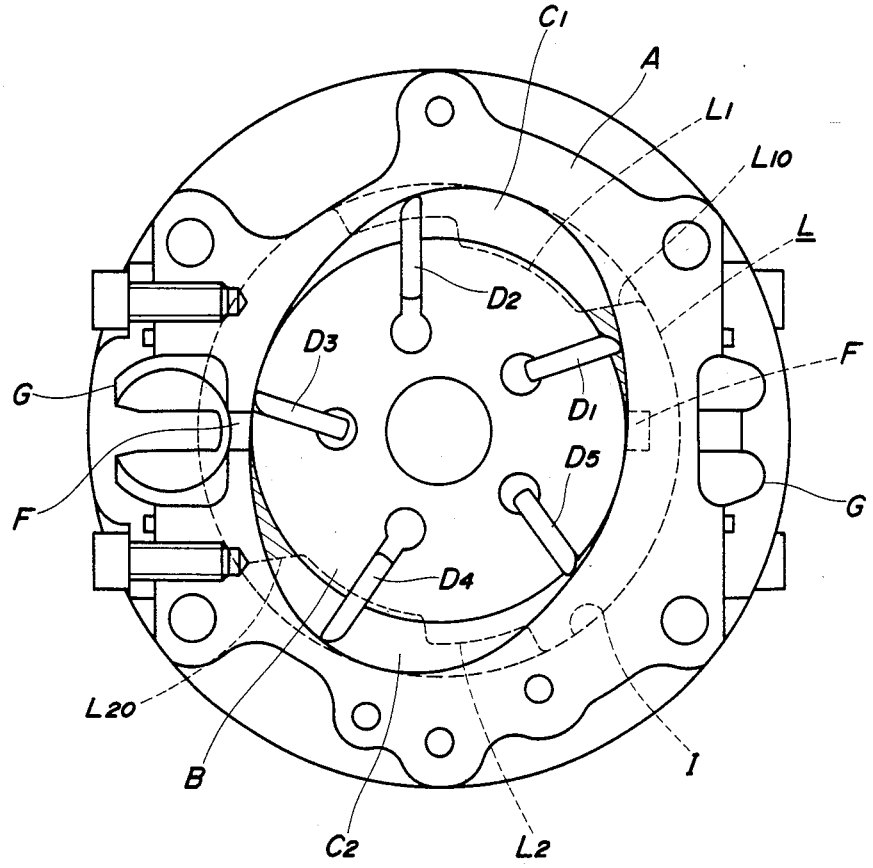
FIG. 2 PRIOR ART
FIG. 2 is a similar view to FIG. 1, showing the conventional compressor in the minimum capacity position.
Figure 3:
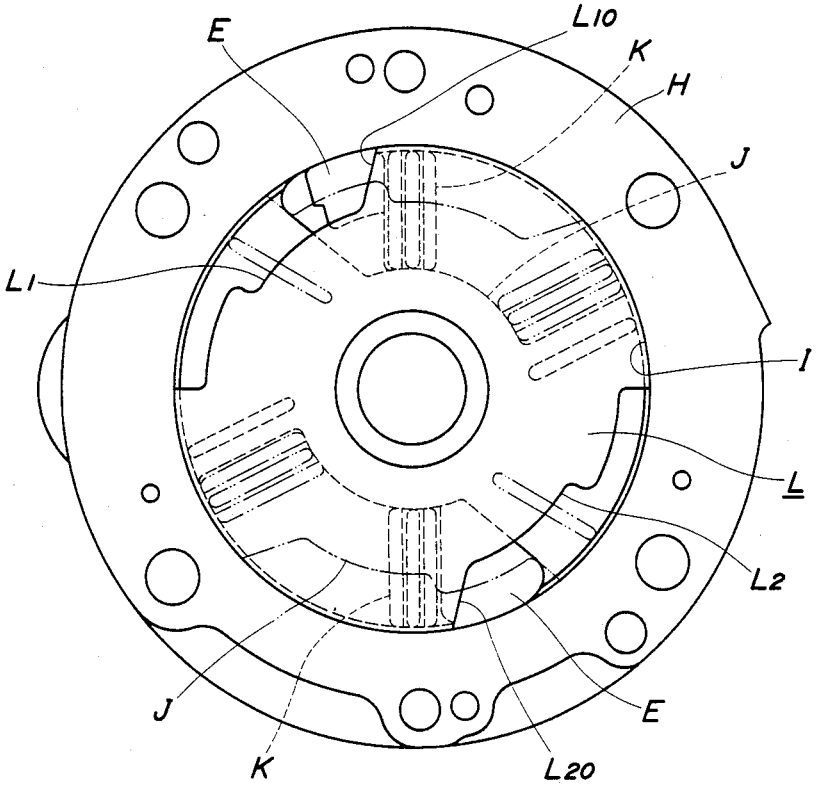
FIG. 3 PRIOR ART
FIG. 3 is an end view showing the control element fitted in an annular recess formed in a rear side block in the conventional vane compressor, as viewed from the rotor side.
Figure 4:
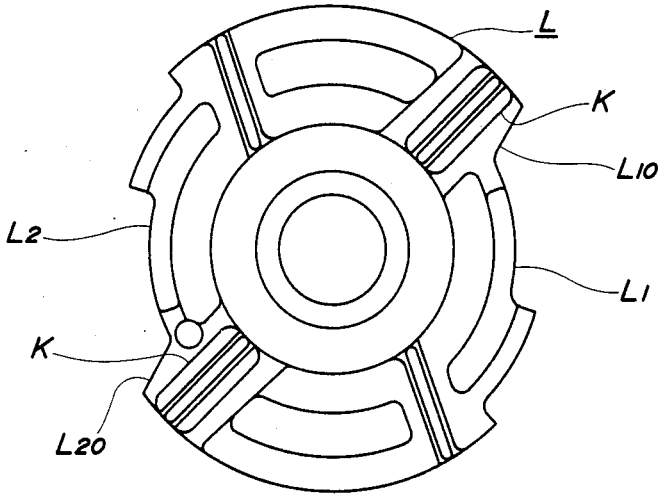
FIG. 4 PRIOR ART
FIG. 4 is an end view of the control element.

The invention will now be described in detail with reference to the drawings showing embodiments thereof.

FIGS. 5 through 14 show a variable capacity vane compressor according to the first embodiment of the invention, wherein a housing 1 comprises a cylindrical casing 2 with an open end, and a rear head 3, which is fastened to the casing 2 by means of bolts, not shown, in a manner closing the open end of the casing 2. A discharge port 4, through which a refrigerant gas is to be discharged as a thermal medium, is formed in an upper wall of the casing 2 at a front end thereof, and a suction port 5, through which the refrigerant gas is to be drawn into the compressor, is formed in an upper portion of the rear head 3. The discharge port 4 and the suction port 5 communicate, respectively, with a discharge pressure chamber 19 and a suction chamber 17, both hereinafter referred to.

A pump body 6 is housed within the housing 1. The pump body 6 is composed mainly of a cylinder formed by a cam ring 7, and a front side block 8 and a rear side block 9 closing open opposite ends of the cam ring 7, a cylindrical rotor 10 rotatably received within the cam ring 7, and a driving shaft 11 which is connected to an engine, not shown, of a vehicle or the like, and on which is secured the rotor 10. The driving shaft 11 is rotatably supported by a pair of radial bearings 12 provided in the side blocks 8 and 9, respectively.

Figure 6:
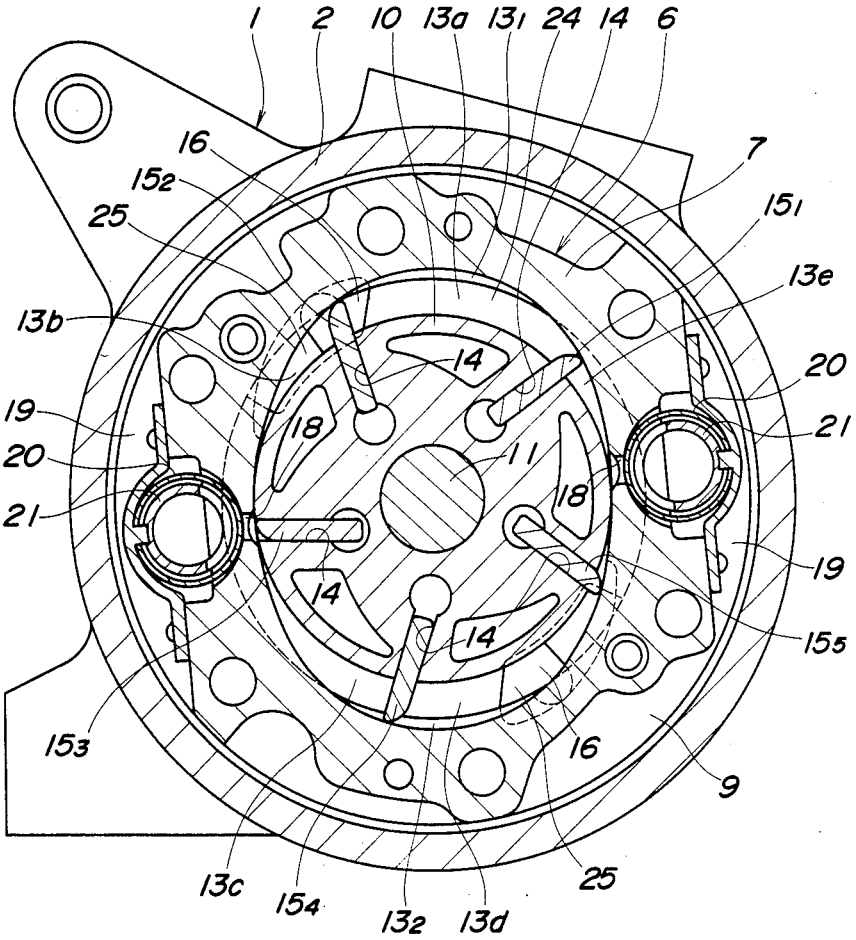
FIG. 6 is a sectional view taken along line VI—VI in FIG. 5.

The cam ring 7 has an inner peripheral surface with an elliptical cross section, as shown in FIG. 6, and cooperates with the rotor 10 to define therebetween a pair of compression spaces $13_1$ and $13_2$ at diametrically opposite locations.

The rotor 10 has its outer peripheral surface formed with a plurality of (five in the illustrated embodiment) axial vane slits 14 at circumferentially equal intervals, in each of which a vane $15_1$–$15_5$ is radially slidably fitted. Adjacent vanes $15_1$–$15_5$ define therebetween five compression chambers 13*a*–13*e* in cooperation with the cam ring 7, the rotor 10, and the opposite inner end faces of the front and rear side blocks 8, 9.

Figure 7:
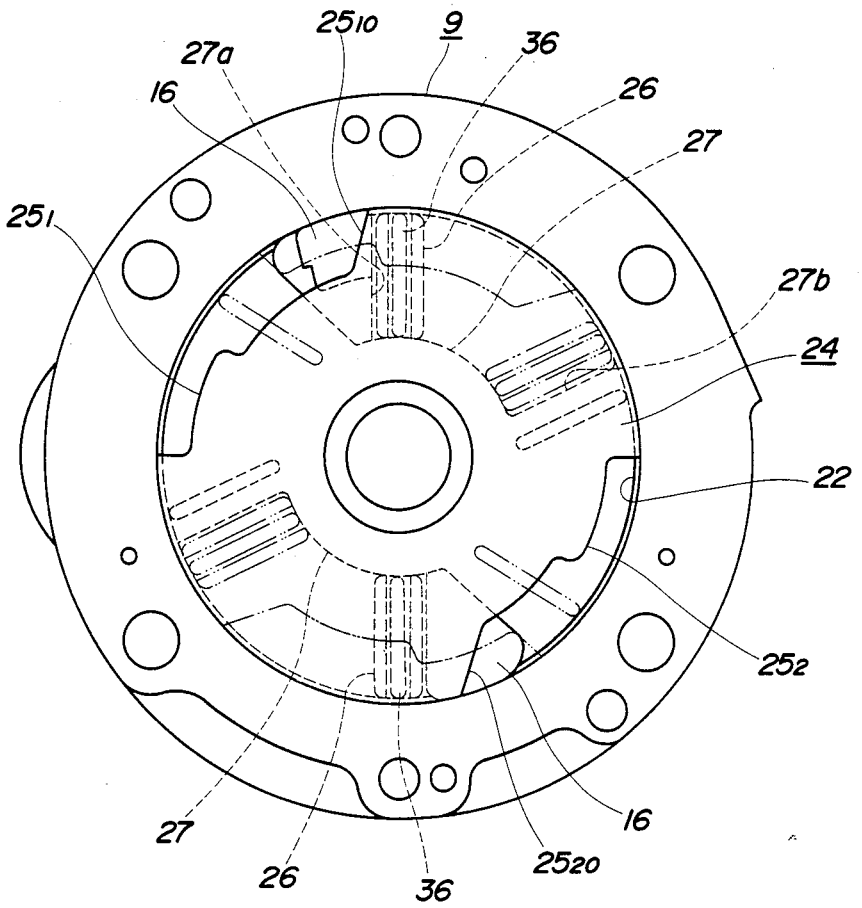
FIG. 7 is an end view showing a control element fitted in an annular recess formed in a rear side block in the compressor of FIGS. 5 and 6.

Refrigerant inlet ports 16 and 16 are formed in the rear side block 9 at diametrically opposite locations as shown in FIGS. 6 and 7. These refrigerant inlet ports 16, 16 are located at such locations that they become closed when the respective compression chambers 13*a*–13*e* assume the maximum volume. These refrigerant inlet ports 16, 16 axially extend through the rear side block 9 and through which the suction chamber (lower pressure chamber) 17 defined in the rear head 3 by the rear side block 9 and the compression chamber 13*b* on the suction stroke are communicated with each other.

Figure 5:
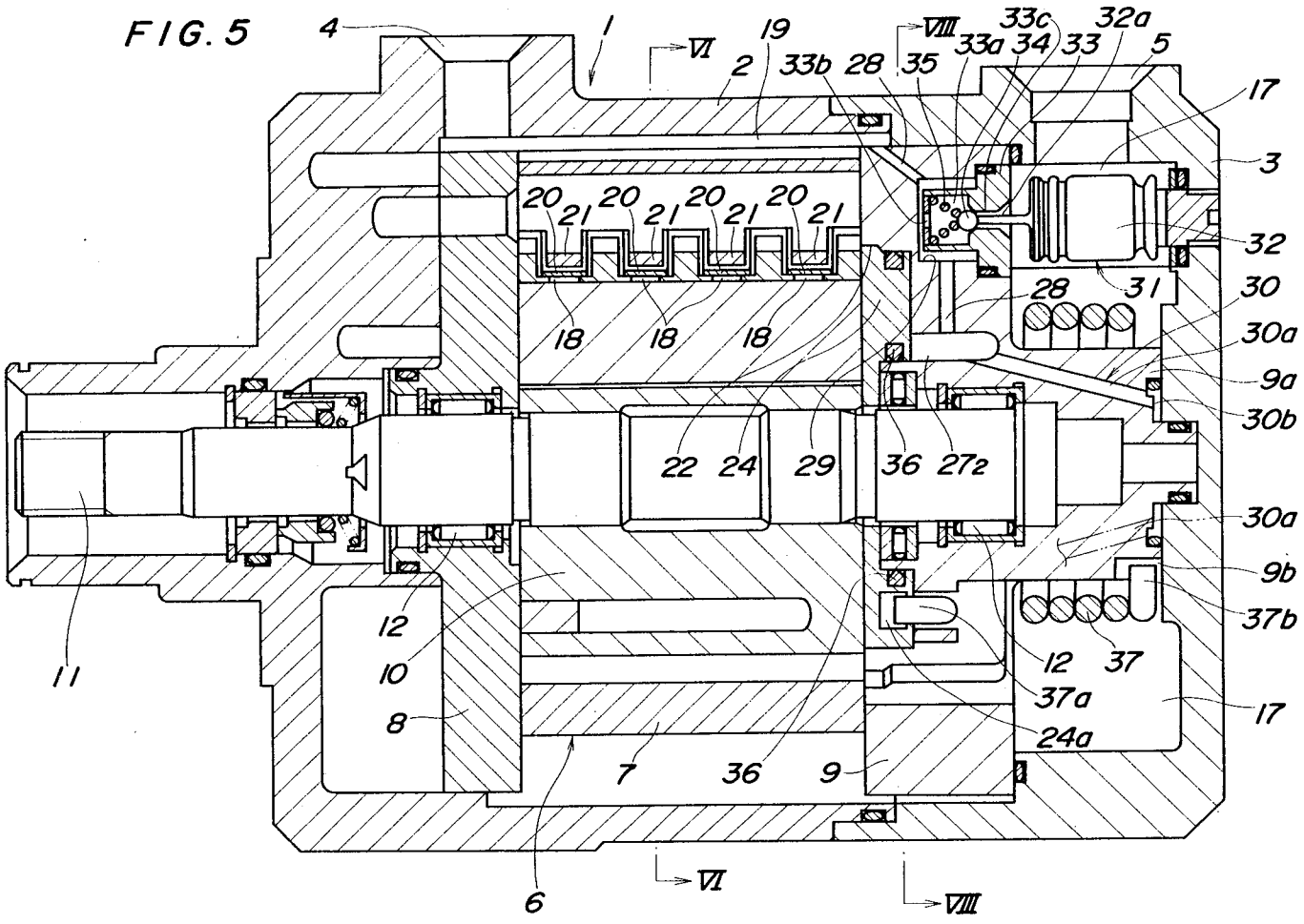
FIG. 5 is a longitudinal cross-sectional view showing a variable capacity vane compressor according to a first embodiment of the present invention.

Refrigerant outlet ports 18 are formed through opposite lateral side walls of the cam ring 7 and through which compression chambers 13*c* and 13*e* on the discharge stroke are communicated with the discharge pressure chamber (higher pressure chamber) 19 defined within the casing 2, as shown in FIGS. 5 and 6. These refrigerant outlet ports 18 are provided with respective discharge valves 20 and valve retainers 21, as shown in FIG. 6.

Figure 9:
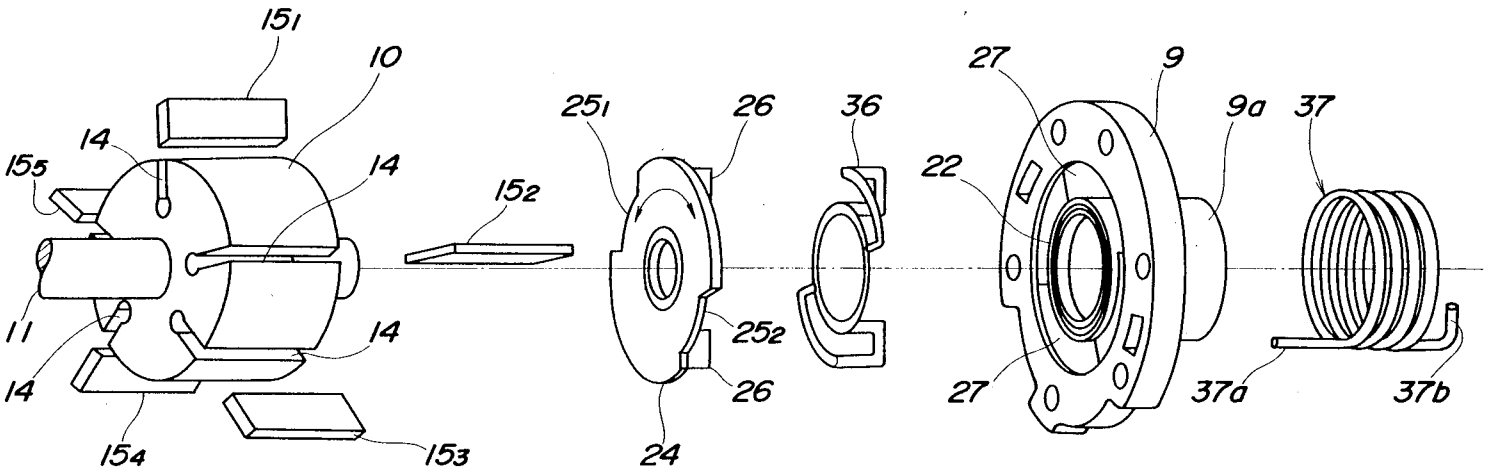
FIG. 9 is an exploded perspective view showing essential parts of the vane compressor according to the first embodiment of the invention.
Figure 10:
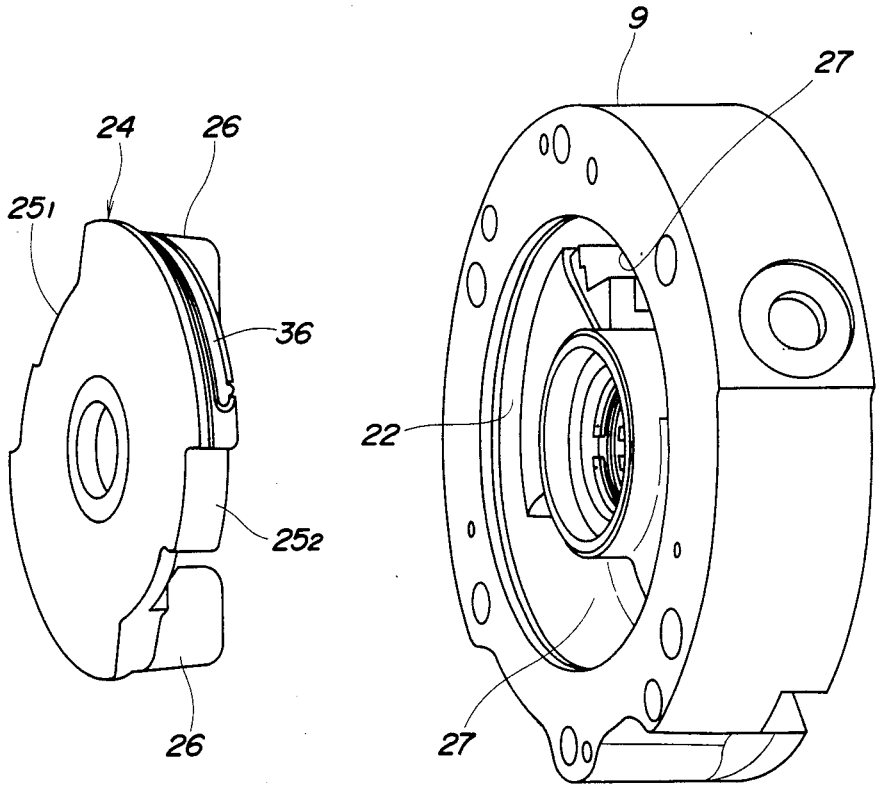
FIG. 10 is an enlarged exploded perspective view showing the rear side block and the control element.
Figure 11:
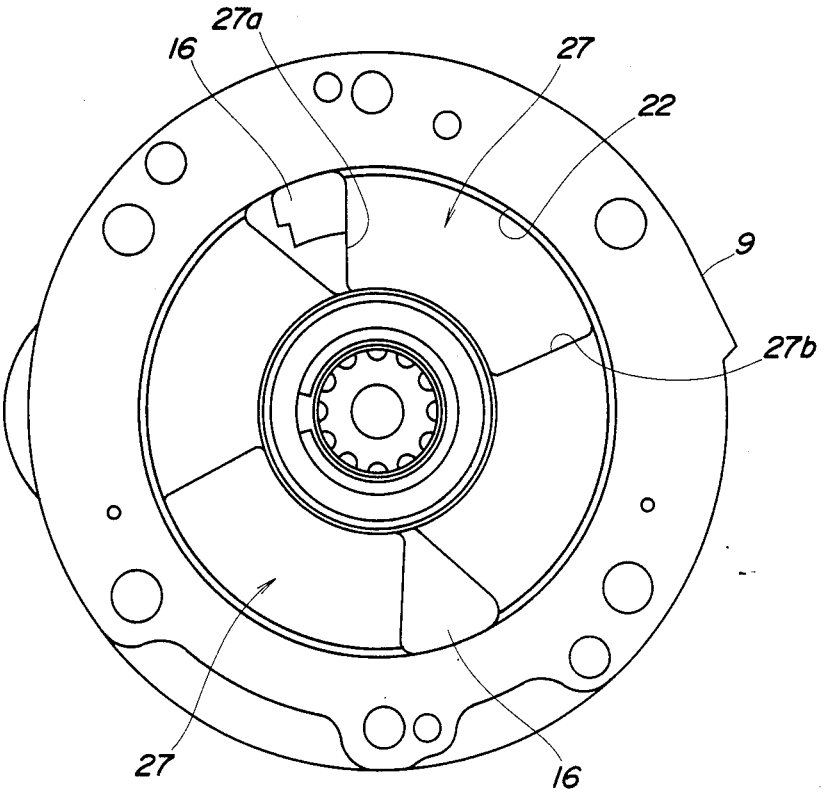
FIG. 11 is an end view showing the rear side block as viewed from the rotor side.
Figure 12:
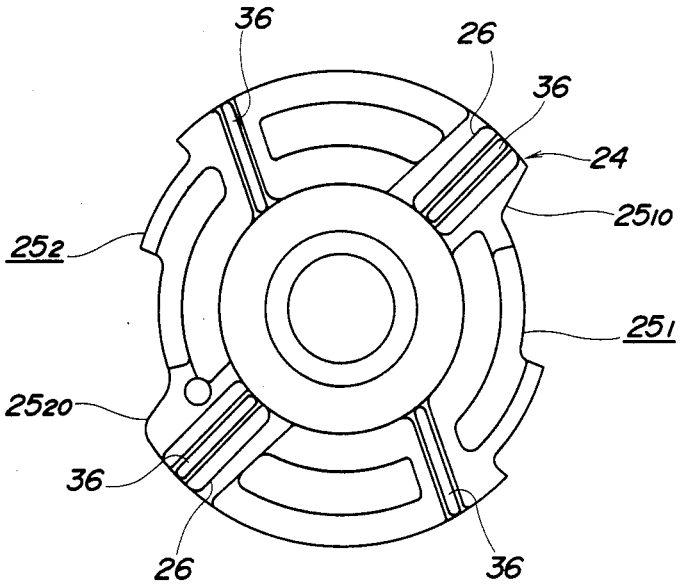
FIG. 12 is an end view showing the control element.
Figure 13:
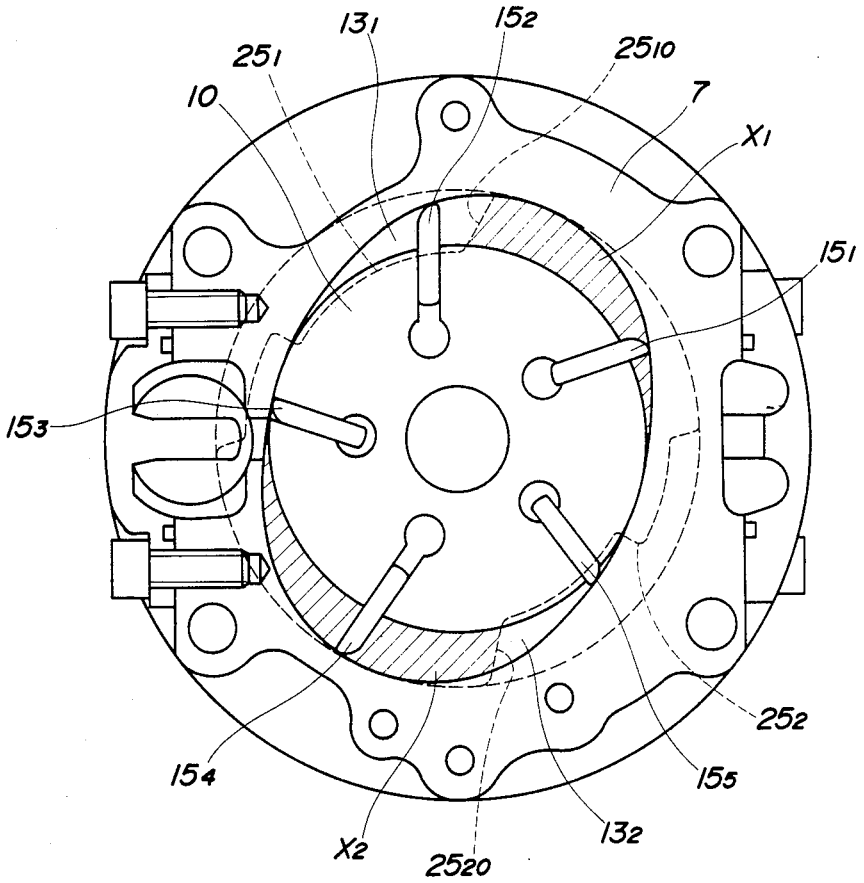
FIG. 13 is a view useful in explaining the positional relationship between vanes and cut-out portions of the control element of the vane compressor according to the first embodiment of the invention, assumed in the maximum capacity position, as well as the compression amount obtained in the maximum capacity position.

The rear side block 9 has an end face facing the rotor 10, in which is formed an annular recess 22 larger in diameter than the rotor 10, as shown in FIGS. 7 and 9 to 11, particularly in FIG. 11. A pair of pressure working chambers 27 and 27 are formed in the annular recess 22 at diametrically opposite locations, as best shown in FIG. 10. One end (trailing end in the direction of rotation of the rotor 10) of each of the pressure working chambers 27 and 27 is communicated with the suction chamber 17 by way of a corresponding one of the refrigerant inlet ports 16 and 16, and the other end (leading end in the direction of rotation of the rotor 10) of each of the pressure working chambers 27 and 27 is communicated with the discharge pressure chamber 19 by way of a high-pressure passage 28 referred to hereinbelow. An annular control element 24 as shown in FIGS. 10 and 12 is received in the annular recess 22 for rotation about its own axis in opposite circumferential directions as shown in FIG. 7. The control element 24 has its outer peripheral edge formed with a pair of approximately diametrically opposite arcuate cut-out portions $25_1$ and $25_2$, and its one side surface formed integrally with a pair of diametrically opposite pressure-receiving protuberances 26 and 26 axially projected therefrom and acting as pressure-receiving elements.

Figure 8:
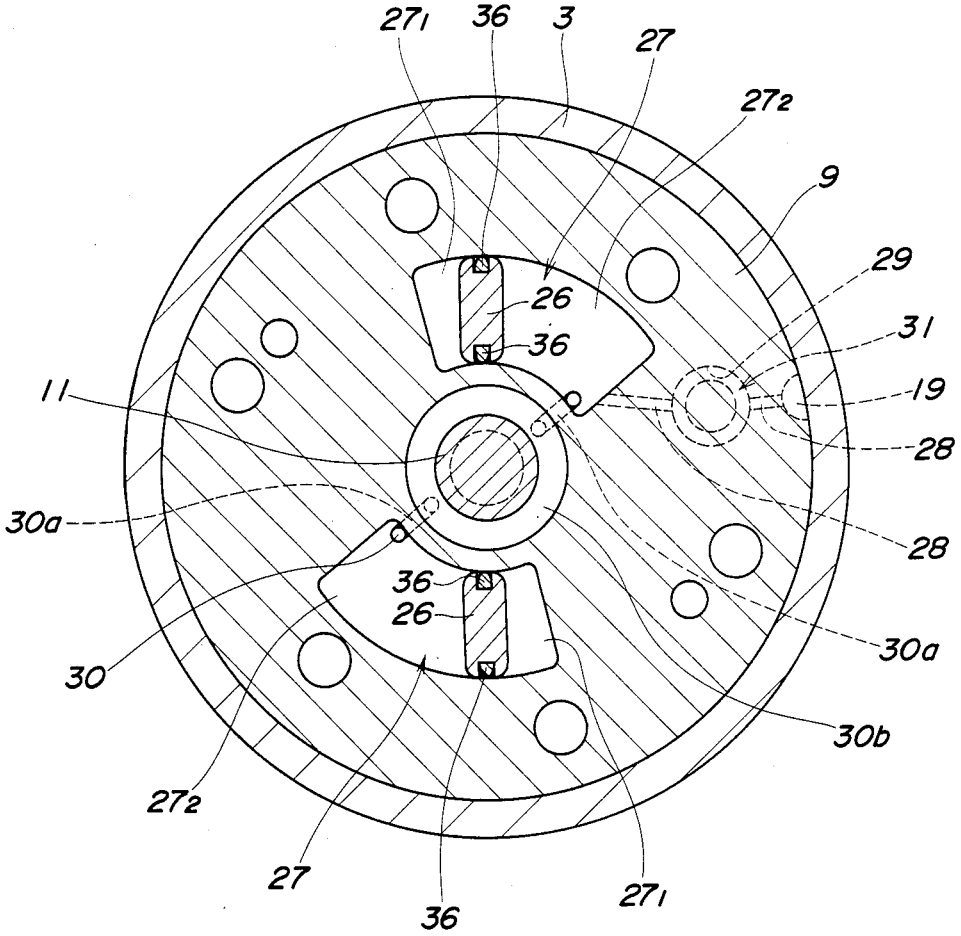
FIG. 8 is a sectional view taken along line VIII—VIII in FIG. 5.

The pressure-receiving protuberances 26, 26 are slidably received in respective pressure working chambers 27 and 27. The interior of each of the pressure working chambers 27, 27 is divided into first and second pressure chambers $27_1$ and $27_2$ by the associated pressure-receiving protuberance 26 as shown in FIG. 8. The first pressure chamber $27_1$ communicates with the suction chamber 17 through the corresponding inlet port 16, and the second pressure chamber $27_2$ communicates with the discharge pressure chamber 19 through the high-pressure passage 28. The two chambers $27_2$, $27_2$ are communicated with each other by way of a communication passage 30 as shown in FIGS. 5 and 8. The communication passage 30 comprises a pair of communication channels 30*a*, 30*a* formed in a boss 9*a* projected from a central portion of the rear side block 9 at a side remote from the rotor 10, and an annular space 30*b* defined between a projected end face of the boss 9*a* and an inner end face of the rear head 3. The communication passages 30*a*, 30*a* are arranged symmetrically with respect to the center of the boss 9*a*. Respective ends of the communication passages 30*a*, 30*a* are communicated with the respective second pressure chambers $27_2$, $27_2$, and the other respective ends are communicated with the annular space 30*b*.

The high-pressure passage 28 is formed in the rear side block 9 as shown in FIG. 5. Arranged in the high-pressure passage 28 is a control valve device 31 responsive to pressure within the suction chamber 17. When the valve of the control valve device 31 is open, pressure within the second pressure chambers $27_2$, $27_2$ is allowed to leak into the suction chamber. The control valve device 31 comprises a flexible bellows 32, a valve casing 33, a ball valve body 34, and a coiled spring 35 urging the ball valve body 34 in its closing direction. The bellows 32 is disposed in the suction chamber 17, with its axis extending parallel with that of the driving shaft 11. When the suction pressure within the suction chamber 17 is above a predetermined value, the bellows 32 is in a contracted state, and when the suction pressure is below the predetermined value the bellows 32 is in an expanded state. The valve casing 33 is fitted in a bore 29 formed in the midway of the high-pressure passage 28 and is opposed to the bellows 32. The valve casing 33 has communication holes 33*b*, 33*c* formed in opposite end walls thereof, and the communication holes 33*b*, 33*c* communicate with each other through a hollow interior 33*a* of the valve casing 33. The ball valve body 34 arranged in the hollow interior 33*a* of the valve casing 41 is disposed to close and open the communication hole 33*c*. The coiled spring 35 is arranged in the hollow interior 33*c* of the valve casing 33 and urges the ball valve body in its closing direction. When the pressure within the suction chamber 17 is above the predetermined value, and therefore when the bellows 32 is in the contracted state, the communication hole 33*c* of the valve casing 33 is closed by the ball valve body 34 by the force of the coiled spring 35. When the pressure within the suction chamber 17 is below the predetermined value, and therefore when the bellows 32 is in the expanded state, the ball valve body 34 is urgedly biased to open the communication hole 33*c* against the force of the coiled spring 35 through a rod 32*a* loosely fitted through the communication hole 33*c*.

A sealing member 36 of a special configuration as shown in FIG. 9 is mounted in the control element 24 and disposed along an end face of its central portion and radially opposite end faces of each pressure-receiving protuberance 26, to seal in an airtight manner between the first and second pressure chambers $27_1$ and $27_2$, as shown in FIG. 8, as well as between the end face of the central portion of the control element 24 and the inner peripheral edge of the annular recess 22 of the rear side block 9, as shown in FIG. 5.

The control element 24 is urged in the counterclockwise direction as viewed in FIG. 7, by a torsion coiled spring 37 fitted around the hub 9*a* of the rear side block 9 axially extending toward the suction chamber 17. The torsion coiled spring 37 has an end 37*a* thereof engaged in an engaging hole 24*a* which is formed in an end face of the control element 24. The other end 37*b* of the torsion coiled spring 37 is engaged in an engaging hole 9*b* formed in an end face of the hub 9*a*.

Thus the control element 24 is rotatable in opposite directions in response to the difference between the sum of the pressure within the first pressure chamber $27_1$ and the urging force of the torsion coiled spring 37, and the pressure within the second pressure chamber $27_2$, within the range between the extreme positions, i.e. the maximum capacity position indicated by the solid lines in FIG. 7 at which the maximum capacity of the compressor can be obtained (in this position, a left end wall of the pressure-receiving protuberance 26 abuts against a maximum capacity stopper 27*a*), and the minimum capacity position indicated by the two-dot chain lines in FIG. 7 (in this position, a right end wall of the pressure-receiving protuberance 26 abuts against a minimum capacity stopper 27*b*). During the suction stroke, the volume of a compression chamber (e.g. the compression chamber 13*a*) defined between two adjacent vanes (e.g. the vanes $15_1$ and $15_2$) of the plurality of vanes $15_1$ to $15_5$ is increased to thereby draw refrigerant into the compression chamber from the suction chamber 17 through the refrigerant inlet port 16. In the meanwhile, a trailing vane of the two adjacent vanes (e.g. the trailing vane $15_2$ of the two adjacent vanes $15_1$ and $15_2$) passes a leading end ($25_{10}$ or $25_{20}$) of a cut-out portion ($25_1$ or $25_2$), whereupon communication between the compression chamber defined between the two adjacent vanes and the refrigerant inlet port 16 is cut off, and at this instant the compression stroke starts. This timing of commencement of compression stroke is retarded as the control element 24 angularly moves in the clockwise direction as viewed in FIG. 7 from the maximum capacity position to the minimum capacity position, whereby the compressor capacity can be continuously decreased.

Further, as shown in FIG. 7, the leading ends $25_{10}$ and $25_{20}$ of the respective cut-out portions $25_1$, $25_2$ are located at asymmetric locations which are circumferentially offset by a predetermined degree of angle from the diametrically symmetric locations. This provides a difference in the time of commencement of compression stroke between the compression space $13_1$ which is controlled by the leading end $25_{10}$ of the cut-out portion $25_1$ and the compression space $13_2$ which is controlled by the leading end $25_{20}$ of the cut-out portion $25_2$. More specifically, as is clearly shown in FIG. 7, the leading end $25_{10}$ of the cut-out portion $25_1$ is located at a location which is offset backward in the direction of rotation of the rotor 10 (in the clockwise direction as viewed in FIG. 7) by a predetermined degree of angle with respect to symmetry in location of the leading ends $25_{10}$ and $25_{20}$, so that in the compression space $13_1$ under the control of the leading end $25_{10}$ of the cut-out portion $25_1$ of the control element 24, the compression stroke of a compression chamber starts later than in the compression space $13_2$ under the control of the leading end $25_{20}$ of the cut-out portion $25_2$. The predetermined degree of angle may be, for example, 10 degrees, whereby in the compression space $13_2$ under the control of the leading end $25_{20}$ of the cut-out portion $25_2$, the compression stroke of a compression chamber in the compression space $13_2$ starts at such a timing that when the control element 24 is in the minimum capacity position, compression of refrigerant is positively carried out to such a degree as to give a sufficient discharge pressure, and accordingly the variable range of the compressor capacity is kept small. At the same time, in the compression space $13_1$ under the control of the leading end $25_{10}$ of the cut-out portion $25_1$, the compression stroke of a compression chamber starts at such a timing that when the control element 24 is in the minimum capacity position, the commencement of compression of refrigerant is so delayed as to hardly effect compression of refrigerant, and accordingly the variable range of he compressor capacity is increased.

The operation of the above-described first embodiment of the invention will now be explained.

As the driving shaft 11 is rotatively driven by a prime mover such as an automotive engine to cause clockwise rotation of the rotor 10 as viewed in FIG. 6, the rotor 10 rotates so that the vanes $15_1$–$15_5$ successively move radially out of the respective slits 14 due to a centrifugal force and back pressure acting upon the vanes and revolve together with the rotating rotor 10, with their tips in sliding contact with the inner peripheral surface of the cam ring 7. During the suction stroke a compression chamber (e.g. compression chamber 13*a*) defined by adjacent ones (e.g. vanes $15_1$ and $15_2$) of the vanes $15_1$ to $15_5$ increases in volume so that refrigerant gas as thermal medium is drawn through the refrigerant inlet port 16 into the compression chamber. The compression stroke starts when the trailing vane of the adjacent vanes (e.g. the trailing vane $15_2$ of the vanes $15_1$ and $15_2$) passes the leading end ($25_{10}$ or $25_{20}$) of a cut-out portion ($25_1$ or $25_2$) to thereby cut off the communication between the compression chamber defined by the adjacent vanes and the refrigerant inlet port 16. During the discharge stroke at the end of the compression stroke the high pressure of the compressed gas forces the discharge valve 20 to open to allow the compressed refrigerant gas to be discharged through the refrigerant outlet port 18 into the discharge pressure chamber 19 and then discharged through the discharge port 4 inot a heat exchange circuit of an associated air conditioning system, not shown.

During the operation of the compressor described above, low pressure or suction pressure within the suction chamber 17 is introduced into the first pressure chamber $27_1$ of each pressure working chamber 27 through the refrigerant inlet port 16, whereas high pressure or discharge pressure within the discharge pressure chamber 19 is introduced into the second pressure chamber $27_2$ of each pressure working chamber 27 through the high-pressure passage 28. The control element 24 is circumferentially displaced in opposite directions between the maximum capacity position indicated by the solid lines in FIG. 7 and the minimum capacity position indicated by the two-dot chain lines in same depending upon the difference between the sum of the pressure within the first pressure chamber $27_1$ and the biasing force of the torsion coiled spring 37 (which acts upon the control element 24 so as to urge same toward the minimum capacity position, i.e. in the clockwise direction as viewed in FIG. 7) and the pressure within the second pressure chamber $27_2$ (which acts upon the control element 24 so as to urge same toward the maximum capacity position, i.e. in the counter-clockwise direction as viewed in FIG. 7). At the same time, the leading ends $25_{10}$, $25_{20}$ of the cut-out portions $25_1$, $25_2$ are displaced accordingly, whereby the timing of commencement of compression stroke is varied to continuously change the delivery quantity of refrigerant gas or the compressor capacity.

For instance, when the compressor is operating at a low speed, the refrigerant gas pressure or suction pressure within the suction chamber 17 is so high that the bellows 32 of the control valve device 31 is contracted to bias the ball valve body 34 to close the communication hole 33*c*, as shown in FIG. 5. Accordingly, the pressure within the discharge pressure chamber 19 is introduced into the second pressure chamber $27_2$. Thus, the pressure within the second pressure chamber $27_2$ surpasses the sum of the pressure within the first pressure chamber $27_1$ and the biasing force of the torsion coiled spring 37 so that the control element 24 is circumferentially displaced toward the maximum capacity position indicated by the solid lines in FIG. 7 in the counter-clockwise direction as viewed in same.

When the control element 24 is in the maximum capacity position, the leading ends $25_{10}$ and $25_{20}$ of the respective cut-out portions $25_1$ and $25_2$ are in the most backward positions in the direction of rotation of the rotor 10. Therefore, the timing the trailing vane of two adjacent vanes (e.g. the trailing vane $15_2$ of the vanes $15_1$ and $15_2$) on the suction stroke passes the leading end (2510 or 2520) of the cut-out portion ($25_1$ or $25_2$) to thereby cut off the communication between the compression chamber defined by the two adjacent vanes and the refrigerant inlet port 16 is the earliest, i.e. the earliest timing of commencement of the compression stroke is obtained. Therefore, when the control element 24 is in the maximum capacity position, the maximum compression volume $X_1$ is obtained in the compression space $13_1$ under the control of the leading end $25_{10}$ of the cut-out portion $25_1$, whereas the maximum compression volume $X_2$ which is larger than the maximum compression volume $X_1$ is obtained in the compression space $13_2$ under the control of the leading end $25_{20}$ of the cut-out portion $25_2$.

Incidentally, although the leading ends $25_{10}$ and $25_{20}$ are circumferentially offset from their diametrically symmetrical locations by about 10 degrees so that the timing of commencement of compression in the compression space $13_1$ differs from that in the compression space $13_2$ by about 10 degrees when the control element assumes the maximum capacity position, almost the same capacity and almost the same discharge pressure can be obtained between the two compression spaces $13_1$ and $13_2$, because the suction efficiency is the same between the two compression spaces.

When the compressor is brought into high speed operation, the suction pressure within the suction chamber 17 is so low that the bellows 32 of the control valve device 31 is expanded so that the rod 32*a* biases the ball valve body 34 in the opening direction against the force of the coiled spring 35 to thereby open the communication hole 33*c*. Thus, the pressure within the second pressure chamber $27_2$ is allowed to leak into the suction chamber 17 through the high-pressure passage 28, the bore 29, the communication hole 33*b*, the hollow interior 33*a*, and the communication hole 33*c*. This causes a sudden drop in the pressure within the second pressure chamber $27_2$, whereby the control element 24 is immediately angularly moved in the clockwise direction as viewed. FIG. 7 toward the minimum capacity position indicated by the two-dot chain lines in FIG. 7.

Figure 14:
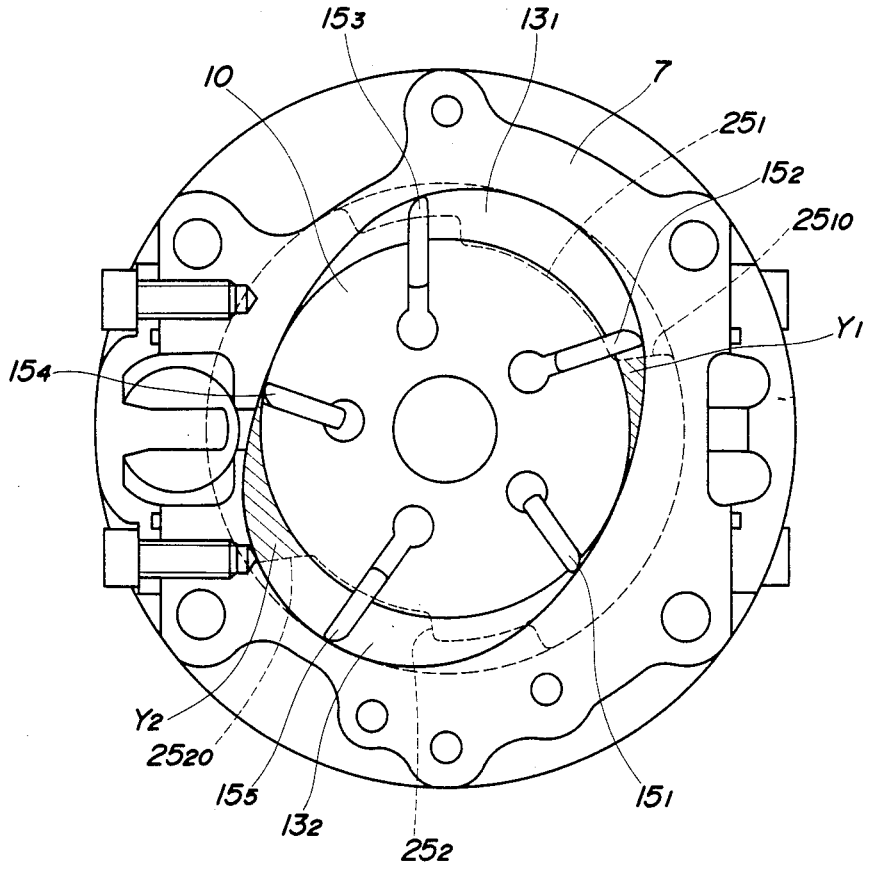
FIG. 14 is a view similar to FIG. 13, showing the vane compressor according to the first embodiment of the invention in the minimum capacity position.

When the control element 24 is in the minimum capacity position, the leading ends $25_{10}$ and $25_{20}$ of the respective cut-out portions $25_1$ and $25_2$ are in the most forward position in the direction of rotation of the rotor 10. Therefore, the timing the trailing vane of two adjacent vanes (e.g. the trailing vane $15_2$ of the vanes $15_1$ and $15_2$) on the suction stroke passes the leading end (2510 or 2520 ) of the cut-out portion ($25_1$ or $25_2$) to thereby cut off the communication between the compression chamber defined by the two adjacent vanes and the refrigerant inlet port 16 is the latest, i.e. the latest timing of commencement of the compression stroke of the compression chamber is obtained. Therefore, when the control element 24 is in the minimum capacity position, the minimum compression volume $Y_1$ is obtained in the compression space $13_1$ under the control of the leading end $25_{10}$ of the cut-out portion $25_1$, whereas the minimum compression volume $Y_2$ which is larger than the minimum compression volume Y1 is obtained in the compression space $13_2$ under the control of the leading end $25_{20}$ of the cut-out portion $25_2$, as shown in FIG. 14.

The minimum compression volume $Y_1$ is such a volume that the ratio of the dead volume to the volume $Y_1$ is so great that compression of refrigerant gas hardly takes place. In other words, when the control element is in the minimum capacity position, the timing of commencement of the compression stroke in the compression space $13_1$ which is under the control of the leading end $25_{10}$ of the cut-out portion $25_1$ is retarded by such a large amount that compression of refrigerant gas hardly takes place, whereby a large variable range of the compressor capacity is obtained.

On the other hand, the maximum compression volume $Y_2$ is such a volume that the ratio of the dead volume to the volume $Y_2$ is so smaller than the maximum volume $Y_1$ that compression of refrigerant gas can positively take place. In other words, when the control element is in the minimum capacity position, the timing of commencement of the compression stroke in the compression space $13_2$ which is under the control of the leading end $25_{20}$ of the cut-out portion $25_2$ is retarded by such a small amount that positive compression of refrigerant gas can take place and sufficient discharge pressure can be produced, whereby a relatively small variable range of the compressor capacity is obtained.

As noted before, the control element 24 can assume any positions between the maximum capacity position and the minimum capacity position in response to the difference in pressure between the first pressure chamber $27_1$ and the second pressure chamber $27_2$, and as the control element 24 moves between the maximum and minimum capacity positions, the positions of the leading ends $25_{10}$ and $25_{20}$ of the cut-out portions $25_1$ and $25_2$ vary correspondingly so that the delivery quantity or capacity varies.

As described above in detail, according to the variable capacity vane compressor of the invention, the two cut-out portions of the control element at substantially diametrically opposite locations have their leading ends in the direction of rotation of the rotor located at diametrically asymmetric locations so as to provide a difference in the timing of commencement of compression between the two compression spaces. That is, in one of the two compression spaces the timing of commencement of compression is relatively early such that positive compression can take place to provide sufficient discharge pressure with the compressor in the minimum capacity position, whereby a moderately small variable range of the compressor capacity is obtained, whereas in the other compression space the timing of commencement of compression is relatively late such that compression can hardly take place with the compressor in the minimum capacity position, whereby a large variable range of the compressor capacity is obtained. Therefore, the compressor as a whole is free from insufficient compression and can provide sufficient discharge pressure even when it assumes the minimum capacity position, thus being practically very useful.

Figure 15:
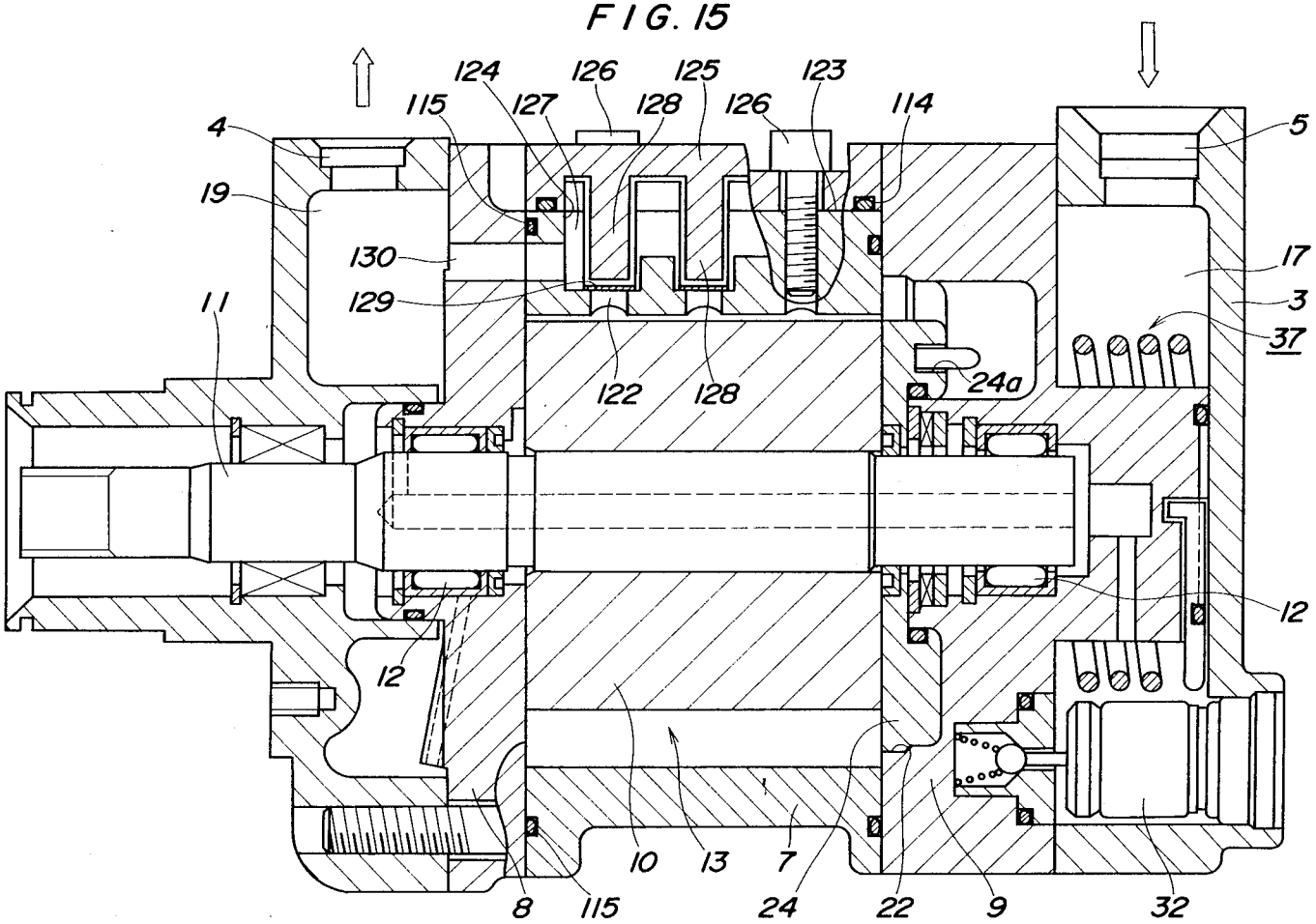
FIG. 15 is a longitudinal cross-sectional view showing a variable capacity vane compressor according to a second embodiment of the present invention.

FIGS. 15 shows a second embodiment of the invention. A variable capacity compressor of the second embodiment is different from the compressor of the first embodiment mainly in that the casing 2 is omitted from the compressor, thereby making the compressor compact in size and reduced in weight. The control element 24 according to the first embodiment can be applied to the compressor of the second embodiment. In FIG. 15, like reference numerals designate elements or parts similar to those in FIG. 5, and description thereof is omitted.

In FIG. 15, the cam ring 7 forms a casing of the compressor together with the front head 8 and rear head 9. The cam ring 7 has e.g. two sets of refrigerant outlet ports 122, 122 (only one set of which is shown) formed through a peripheral wall thereof and arranged at circumferentially opposite locations with respect to the axis of the compressor. The refrigerant outlet ports 122, 122 have one end thereof opening into compression spaces $13_1$, $13_2$ in the neibourhood of portions with reduced diameter of the peripheral wall of the cam ring 7. Onter peripheral surface portions 123, 123 of the cam ring 7 formed with the refrigerant outlet ports 122, 122 are cut in the form of flat surfaces for mounting covers 125, 125 thereon (only one of the surfaces is shown). The cover-mounting portions 123, 123 have respective recesses 124, 124 (only one of which is shown) formed therein which each have e.g. three circumferantially extending grooves with arcuate bottom surfaces formed therein. The refrigerant outlet ports 122, 122 have other ends thereof opening into the respective recesses 124, 124.

The covers 125, 125 (one of which is shown) are screwed respectively to the cover-mounting portions 123, 123 of the cam ring 7 by means of e.g. four mounting bolts 126 (two of which are shown). O-rings 114 are interposed between the covers 125, 125 and the cover-mounting portions 123, 123 of the cam ring 7, to maintain airtightness between the recesses 124, 124 and the outside. The covers 125, 125 have respective arcuate recesses formed in inner peripheral surfaces thereof, which form spaces 127, 127 for accommodating discharge valves 129, 129 (one of the spaces is shown), together with the recesses 124, 124 of the cam ring 7. The covers 125, 125 have six stopper portions 128 (two of which are shown) projecting integrally therefrom toward the cam ring 7 and opposed to the respective refrigerant outlet ports 122.

In the spaces 127, 127, the discharge valves 129, 129 (one of which is shown) are arranged as is known from Japanese Utility Model Publication (Kokai) No. 62-132289. The discharge valves 129, 129 are formed of a single elastic sheet member rolled in a form of cylinder. The cylinder has a slit, not shown, axially extending therethrough and resiliently fit and secured on an axial ridge, not shown, formed on the inner surface of the cover 125, thus being supported by the latter.

The discharge valves 129, 129 have cylindrical end faces thereof in contact with the other ends of the respective refrigerant outlet ports 122, thereby closing the ports 122 except during the discharge stroke of the compressor.

The discharge pressure chamber (higher pressure chamber) 19 and the discharge valve-accommodating spaces 127, 127 are communicated with each other through communicating passages 130, 130 (one of which is shown) formed in the cam ring 7 and the front side block 8. Respective ends of the passages 130, 130 opening into the spaces 127, 127 are arranged radially inwardly of an O-ring 115 which is interposed between the cam ring 7 and the front side block 8 for maintaining airtightness between the communicating passages 130, 130 and the outside.

The annular control element 24 is receined in the annular recess 22 formed in the rear side block 9 for rotation about its own axis in opposite circumferential directions. The control element 24 in the second embodiment has substantially the same shape and function as that in the first embodiment, detailed description of which is therefore omitted.

With the above construction, during the discharge stroke, the discharge valves 129, 129 are urgedly deformed by the force of compressed regrigerant gas until they are brought into contact with the stopper portions 128, whereby the compressed gas is discharged into the spaces 127, 127. The gas discharged into the spaces 127, 127 is then delivered into the discharge pressure chamber 19 through the communicating passages 130, 130, and then discharged out of the compressor through the discharge port 4.

As described above, according to the ninth embodiment of the invention, the recesses 124, 124 into which the refrigerant outlet ports 122, 122 open are formed in the outer peripheral surface of the cam ring 7, the covers 125, 125 are mounted on the cam ring so as to cover the respective recesses 124, 124, whereby the spaces 127, 127 are formed between the cam ring 7 and the covers 125, 125, in which the discharge valves 129, 129 are arranged, and the communicating passages 130, 130 are formed in the cam ring 7 and the side block to communicate with the spaces 127, 127 with the dischange pressure chamber 19. The casing of the compressor is thus omitted, thereby making the compressor compact in size and reduced in weight. Further, also the compressor of the second embodiment can obtain a large variable range of capacity as well as sufficient discharge pressure even in the minimum capacity position in which the minimum compressor amount is obtained, by virtue of employment of the control element 24 as employed in the first embodiment.

What is claimed is:

1. In a variable capacity vane compressor having a cylinder, a rotor rotatably received within said cylinder, a pair of compression spaces being defined between said cylinder and said rotor at diametrically opposite locations, a plurality of vanes carried by said rotor, a control element disposed in said cylinder for rotation about an axis thereof in circumferentially opposite directions, said control element having an outer peripheral edge thereof formed with a pair of cut-out portions at substantially diametrically opposite locations, said cut-out portions each having a leading end in the direction of rotation of said rotor, a lower pressure zone, a higher pressure zone, and means for rotating said control element in response to a difference between pressure from said lower pressure zone and pressure from said higher pressure zone, wherein compression of compression fluid commences when each of said vanes passes said leading end of each of said cut-out portions, whereby the rotation of said control element causes a change in the circumferential position of each of said cut-out portions to thereby vary the timing of commencement of compression in a corresponding one of said compression spaces and hence vary the capacity of the compressor, the improvement wherein said leading ends of said cut-out portions of said control element are located at diametrically asymmetric locations to provide a difference in the timing of commencement of compression between said compression spaces.

2. A variable capacity vane compressor as claimed in claim 1, wherein said leading end of one of said cut-out portions is located at such a circumferential location as to provide a first compression amount of substantially zero when said control element is in a minimum capacity position, and said leading end of the other cut-out portion is located at such a circumferential location as to provide a second compression amount which is greater than said first compression amount when said control element is in said minimum capacity position.

* * * * *